US008201547B2

(12) United States Patent
Wood

(10) Patent No.: US 8,201,547 B2
(45) Date of Patent: Jun. 19, 2012

(54) BOLT AND VALVE MECHANISM THAT USES LESS GAS

(75) Inventor: Jack Kingsley Wood, Chesire (GB)

(73) Assignee: Planet Eclipse Limited, Manchester (GB)

( * ) Notice: Subject to any disclaimer, the term of this patent is extended or adjusted under 35 U.S.C. 154(b) by 0 days.

(21) Appl. No.: 13/334,575

(22) Filed: Dec. 22, 2011

(65) Prior Publication Data

US 2012/0090586 A1 Apr. 19, 2012

Related U.S. Application Data

(63) Continuation of application No. 12/906,318, filed on Oct. 18, 2010, now Pat. No. 8,104,463.

(60) Provisional application No. 61/252,750, filed on Oct. 19, 2009.

(51) Int. Cl.
*F41B 11/00* (2006.01)

(52) U.S. Cl. ..... 124/75

(58) Field of Classification Search ..... 124/73, 124/75

See application file for complete search history.

(56) References Cited

U.S. PATENT DOCUMENTS

| | | | | |
|---|---|---|---|---|
| 4,850,330 | A | 7/1989 | Nagayoshi | |
| 4,936,282 | A | 6/1990 | Dobbins et al. | |
| 5,078,118 | A | 1/1992 | Perrone | |
| 5,257,614 | A | 11/1993 | Sullivan | |
| 5,339,791 | A * | 8/1994 | Sullivan | 124/73 |
| 5,349,938 | A * | 9/1994 | Farrell | 124/73 |
| 5,613,483 | A | 3/1997 | Lukas et al. | |
| 5,778,868 | A * | 7/1998 | Shepherd | 124/76 |
| 6,035,843 | A | 3/2000 | Smith et al. | |
| 7,044,119 | B2 * | 5/2006 | Jones | 124/74 |
| 7,509,953 | B2 * | 3/2009 | Wood | 124/73 |
| 7,527,049 | B2 * | 5/2009 | Sheng | 124/73 |
| 7,617,819 | B2 * | 11/2009 | Jones | 124/74 |
| 7,640,925 | B2 * | 1/2010 | Jones | 124/73 |
| 7,640,926 | B2 * | 1/2010 | Jones | 124/74 |
| 7,921,839 | B2 * | 4/2011 | Wood | 124/73 |
| 7,997,260 | B2 | 8/2011 | Kaakkola et al. | |
| 2004/0084040 | A1 | 5/2004 | Jones | |
| 2004/0089280 | A1 * | 5/2004 | Kunimoto | 124/76 |
| 2005/0005924 | A1 * | 1/2005 | Sheng | 124/74 |
| 2005/0115550 | A1 * | 6/2005 | Jones | 124/65 |
| 2005/0115554 | A1 * | 6/2005 | Jones | 124/74 |
| 2005/0188977 | A1 * | 9/2005 | Wygant | 124/73 |
| 2006/0011186 | A1 | 1/2006 | Jones et al. | |
| 2006/0090739 | A1 * | 5/2006 | Jones | 124/73 |
| 2006/0157043 | A1 * | 7/2006 | Jones | 124/74 |
| 2006/0169266 | A1 * | 8/2006 | Carnall et al. | 124/75 |
| 2007/0028909 | A1 * | 2/2007 | Wood | 124/73 |
| 2007/0151549 | A1 * | 7/2007 | Wood | 124/73 |

(Continued)

*Primary Examiner* — Troy Chambers
(74) *Attorney, Agent, or Firm* — Barlow, Josephs & Holmes, Ltd.

(57) ABSTRACT

The proposed invention is a new bolt and gas release valve mechanism for a projectile launching device, such as a paintball marker, that uses significantly less gas per shot than prior art devices. The open gas chamber between the projectile, such as a paintball, and the gas release mechanism is eliminated thereby requiring much less gas to be used for each launch of a given projectile. Thus, only the launching gas to propel the projectile is needed and not the additional gas required to fill the chamber in the bolt directly behind the projectile. This enables desirably smaller gas supply tanks to be used during use to launch the same number of projectiles. Also, with the present invention, more projectiles can be launched using the same gas supply tank.

7 Claims, 6 Drawing Sheets

U.S. PATENT DOCUMENTS

2007/0175465 A1* 8/2007 Quinn et al. ..... 124/74
2007/0181117 A1 8/2007 Tippermann et al.
2007/0209650 A1* 9/2007 Jones ..... 124/73
2007/0227519 A1 10/2007 Wood
2008/0087265 A1 4/2008 Yeh
2009/0064980 A1* 3/2009 Yeh ..... 124/71
2009/0101129 A1 4/2009 Wood et al.
2009/0178661 A1* 7/2009 Wood ..... 124/73
2010/0101550 A1* 4/2010 Carnall ..... 124/76
2010/0108049 A1 5/2010 Dobbins
2011/0088675 A1 4/2011 Wood
2011/0232618 A1 9/2011 Gabrel

* cited by examiner

BOLT AND VALVE MECHANISM THAT USES LESS GAS

CROSS REFERENCE TO RELATED APPLICATION

This application is a continuation of Ser. No. 12/906,318, filed Oct. 18, 2010, which is related to and claims priority from earlier filed provisional patent application Ser. No. 61/252,750, filed Oct. 19, 2009, all of which is incorporated herein by reference.

BACKGROUND OF THE INVENTION

The present invention relates generally to devices and apparatuses for launching projectiles, such as paintballs. These devices are commonly called paintball guns or paintball markers. The present invention, more specifically, relates to the bolt and valve mechanism in such devices and apparatuses that are employed for preparing the gas behind the projectile and then releasing the gas for launch of the projectile. For ease of discussion and illustration, the present invention will be discussed in connection with launching a paintball, as an example projectile, and a paintball marker as an example of a device that incorporates the mechanism of the present invention. However, it should be understood that this invention relates to and can be used in any type of gas projectile launcher for launching any type of projectile.

In the prior art, gas powered guns or markers are well known in the art. In general, these devices include a supply of gas that fills a chamber, which is then emptied to launch a projectile, namely, a paintball. Valving is typically provided in the marker to control the flow of gas therein. In the prior art, various types of bolts and valving can be employed. For example, electrically operated solenoid valves and mechanical valves have been employed for this purpose. One example of such a mechanical valve used in paintball markers is a "spool" valve. These are so well known that they need not be discussed in detail herein. These spool valves are very common for use in connection with paintball markers.

Gas within a marker not only provides power for launching a projectile but also is commonly used to control loading and launching of the projectile. In other words, gas can also be used to control bolt movement within a marker to, in turn, control position of a paintball. There are number of prior art patents that use this concept. U.S. Pat. Nos. 6,035,843 and 5,613,483 both use the existing gas supply for bolt control. The gas pneumatically actuates the bolt back and forth, as desired. Also, springs can be used for actuation of the bolt in certain directions. In these sample prior art systems, a unitary bolt construction is used for the dual purpose of controlling flow of gas to a storage chamber to serve as the power to launch the projectile and as well as serving as a conventional bolt that moves the projectile to a launch position while preventing additional projectiles from entering the breech.

Essentially, prior art bolt unitary constructions typically have a standard bolt at one end and a gas control at the opposing end so that its actuation back and forth can be pneumatically controlled. The bolt reciprocates back and forth within the marker. With the appropriate timing, gas fills the appropriate chamber with the bolt assembly when the bolt construction is rearwardly positioned. When the bolt moves forward, the paintball is moved forward into a launching position. This forward motion causes the appropriate passageways within the marker so that the stored gas is released behind the paintball for launching thereof.

As can be seen in FIGS. 1 and 2, two examples of such prior art projectile launching devices are shown. More specifically, the prior art bolt and air release mechanisms are shown to illustrate the preparation and use of gas to launch a paintball. These existing prior art paintball markers typically have linear reciprocating bolt mechanisms. These prior art markers always have an empty volume within the marker that is situated between the back of the paintball and the air release valve. The air release valve is the device that releases the blast of gas that is used to propel the paintball.

Referring first to FIG. 1, a prior art paintball marker 10 includes an outer housing 12 with a barrel 14 connected thereto with a breech 16 for receiving a paintball 18, via a feed tube 19, from a hopper (not shown) or the like. A sliding bolt 20 is provided inside the housing 12. The first portion 20*a* of the bolt 20 communicates with the paintball 18 to be launched while the second portion 20*b* of the bolt 20 communicates with an o-ring 26 to form of a poppet valve. In this case, the second portion 20*b* of the bolt 20 provides an airtight seal to secure a firing gas chamber 24. Gas is supplied, in the typical fashion and using known constructions, such as solenoid valves and the like (not shown), to the chamber 24 behind the seal. As the bolt 20 moves forward, the paintball 18 is moved into the launch position in the barrel 14, as indicated by the arrows inside the bolt. With further forward movement of the bolt 20, the second portion 20*b* of the bolt 20 separates from o-ring 26 at region 20*c* to break the seal 26 therebetween. This permits gas in chamber 24 to fill the empty chamber 28 inside the bolt 20 to, in turn, launch the paintball 18. For this prior art configuration, filling chamber 28 for each firing cycle requires substantial amounts of additional gas.

Similarly, in FIG. 2, this prior art paintball marker 50 includes an outer housing 52 with a barrel 54 connected thereto with a breech 56 for receiving a paintball 58 from a hopper (not shown) or the like. A sliding bolt 60 is provided inside the housing 52. The front end 60*a* of the bolt 60 communicates with the paintball 58 to be launched while the rear end 60*b* of the bolt 60 communicates with a gas release member 62 to form of a poppet valve. In this case, the valve interconnection between the bolt 60 and the gas release member 62 is of a slightly different configuration where the free front end 62*a* of the gas release member 62 slidably engages with the inner surface 60*c* of the bolt 60. The rear opening 60*d* of the bolt 60 still provides an airtight seal with the gas release member 62 via an o-ring 64, for example. Gas is supplied, in the typical fashion, as above, and using known constructions, such as solenoid valves and the like (not shown), to the chamber 66 behind the seal between the gas release member 62 and the bolt 60. As the bolt 60 moves forward, the paintball 58 is moved into the launch position in the barrel 54, as indicated by the arrows inside the bolt. The gas release member 62 separates from the rear end 60*b* of the bolt 60 to open the seal therebetween thereby permitting release of the gas trapped in the chamber 66 to fill the empty chamber 68 inside the bolt 60 to, in turn, launch the paintball 58. For this prior art configuration, filling chamber 68 for each firing cycle requires substantial amounts of additional gas.

In both of these example prior art devices, in FIGS. 1 and 2, a large chamber behind the paintball and within the bolt must be filled prior to a paintball launch with air released from the firing chamber, behind the seal, for later complete evacuation such launch. In these prior art bolt and valve constructions, gas is wasted during every shot by having to fill this empty chamber volume in the bolt from the air released from the firing chamber during every shot. This volume is not an inconsiderable amount and having to fill it every shot has a detrimental effect on the overall efficiency of the marker thereby drawing gas from the cylinder faster than necessary. It is highly desirable to avoid such wasted gas.

While these prior bolt constructions effectively control gas flow and launching of a paintball, they suffer from many disadvantages that result from inefficiencies in the flow and use of gas within a marker. This is of high concern because paintball is played with paintball markers that operate off compressed air or compressed carbon dioxide. The presence or amount remaining of a source of gas is, therefore, of concern for operation of these markers. These gases are typically carried in compressed gas cylinders that are either mounted directly to the paintball marker, or to the paintball player who carries the cylinder on their person, and the gases are transferred to the marker via a length of hose. In either case it is beneficial to use as small a cylinder as is possible as the weight of the cylinder is an unwanted hindrance to the player as it is heavy and bulky. In order to have a small cylinder, and still be able to fire a high quantity of paintballs, it is essential that the paintball marker is as gas efficient as possible. The more efficient a marker is, the smaller the compressed gas tank can be.

Therefore, it is envisioned that if this wasteful empty volume, located behind the paintball and, typically, inside the bolt, could be eliminated from the design of a paintball marker, it has the potential to significantly increase the efficiency of the marker, allowing more shots from a given cylinder size, or the use of smaller cylinders to be able to shoot the same number of shots.

In view of the foregoing, there is a need to make a marker more efficient in its use of gas. There is also a need for a marker to use less gas for each paintball launch. There is a further need for a marker that requires smaller gas cylinders to provide operational gas. There is a need for a marker that has an improved bolt and valve mechanism that enables more paintballs to be launched from a given cylinder of gas than prior art markers.

SUMMARY OF THE INVENTION

An embodiment of the present invention preserves the advantages of prior art gas powered guns or markers. In addition, it provides new advantages not found in currently available gas powered guns or markers and overcomes many disadvantages of such currently available gas powered guns or markers.

The proposed invention is a new bolt and air release valve mechanism for a paintball marker that uses significantly less gas per shot. The open gas chamber between the paintball and the air release mechanism is eliminated thereby requiring much less gas to be used for launching a given paintball. The construction of the bolt and gas release member is configured move the location of the seal between the bolt and the gas release member to right behind the paintball to be launched. Thus, only the launching gas to propel the paintball is needed and not the additional gas required to fill the chamber in the bolt directly behind the paintball.

It is therefore an object of the embodiment to provide a bolt and valve mechanism that uses less gas.

It is a further object of the embodiment to provide a marker with a bolt and valve system that uses less gas for each paintball launch than prior art markers.

Another object of the embodiment to provide a marker that requires a smaller gas cylinder than prior art markers to launch the same number of paintballs.

Yet another object of the present invention is to provide a marker that is more efficient than prior art markers due to use of less gas for each paintball launch.

BRIEF DESCRIPTION OF THE DRAWINGS

The novel features which are characteristic of the pneumatic launching assembly are set forth in the appended claims. However, the pneumatic launching assembly, together with further embodiments and attendant advantages, will be best understood by reference to the following detailed description taken in connection with the accompanying drawings in which:

DETAILED DESCRIPTION OF THE PREFERRED EMBODIMENTS

The improved bolt and valve mechanism of the present invention allows for a marker design that has the potential to have zero empty volume to fill between the gas release mechanism, namely between a gas release member and the bolt, and the back of the paintball. As a result, a marker equipped with the bolt and valve mechanism of the present uses less gas for operation than prior art markers.

In accordance with the present invention, the improved bolt and valve mechanism carries the air release mechanism inside the bolt mechanism rather than at the end thereof as in the prior art. As a result, and as the bolt moves, the air release mechanism moves with it. Namely, the sealing connection of the bolt and the free end of the gas release member is directly behind the paintball. The seal and sealing poppet of the air release mechanism are both sited, and move together with, the bolt body.

Figure 1:
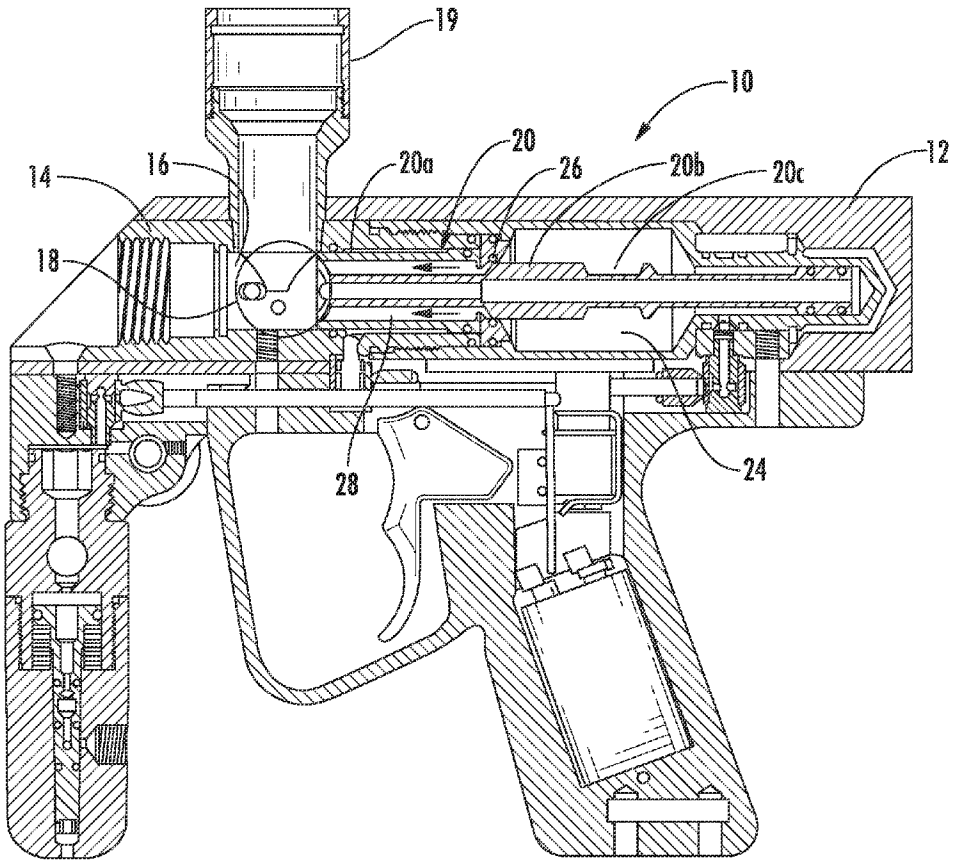
FIG. 1 (PRIOR ART)
FIG. 1 is a cross-sectional view of a prior art marker with wasteful gas space between the projectile and the air release valve.
Figure 2:
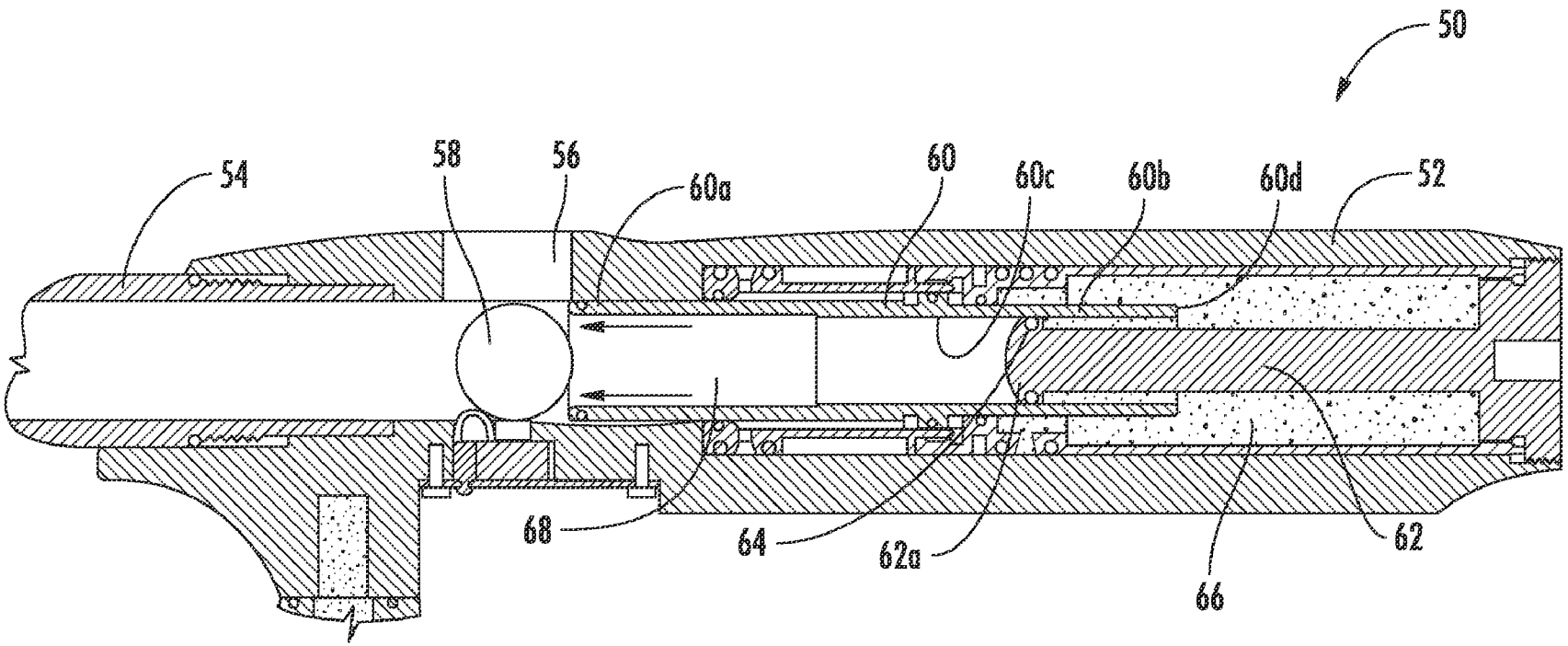
FIG. 2 (PRIOR ART)
FIG. 2 is a cross-sectional view of another example of a prior art marker with wasteful gas space between the projectile and the air release valve.
Figure 3:
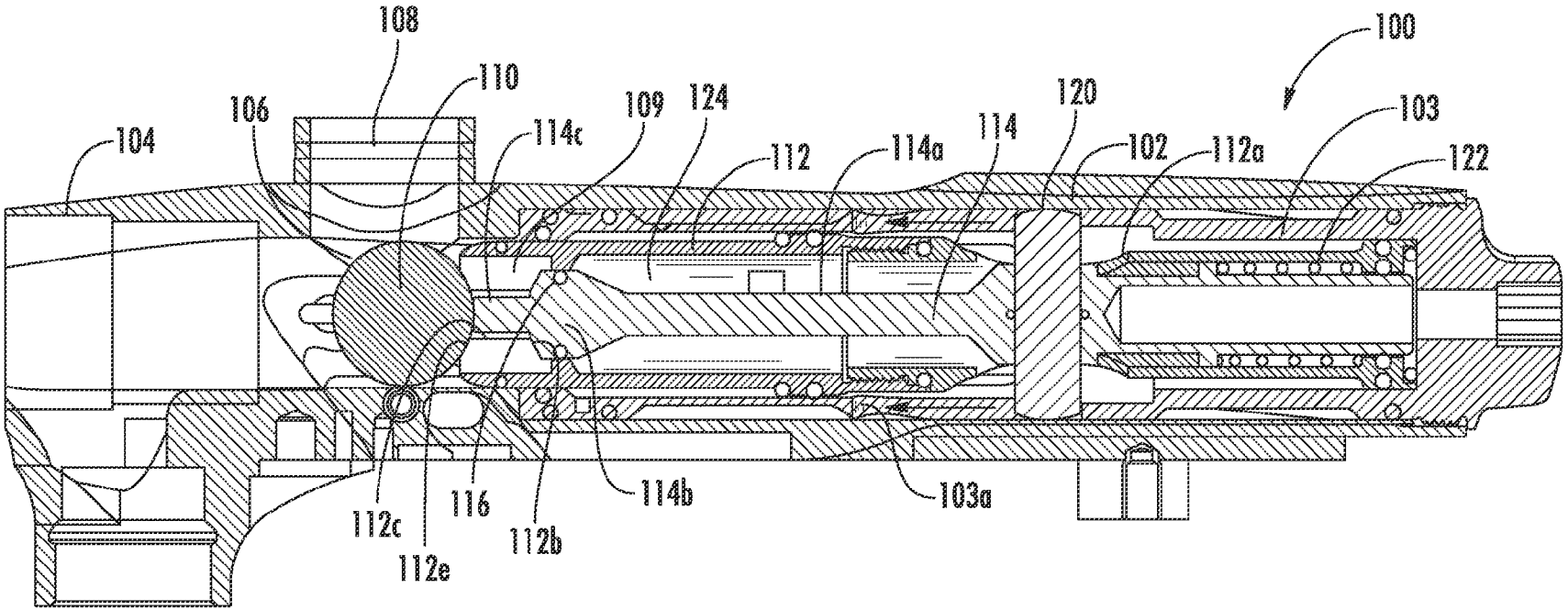
FIG. 3 is a cross-sectional view of a marker with the bolt and valve mechanism of the present invention in a position for projectile loading.

FIGS. 3-6 illustrate the operation and construction of the system of the present invention in detail. Turning first to FIG. 3, a cross-sectional view of a paintball marker 100 that employs the improved bolt and valve mechanism of the present invention is shown. The marker includes an outer housing 102 with a sleeve 103 that is connected to a barrel 104 with a breech 106 disposed therebetween. Paintballs 110 are fed from, for example, a hopper (not shown) into the breech 106 via a feed tube. Uniquely, a bolt 112 and gas release member 114 are slidably disposed in the sleeve 103 in the housing 102. The gas release member 114 and the bolt 112 provide a poppet-like valve construction, however, the chamber (28, as seen in FIG. 1) between the point of sealing and the paintball 110 is preferably substantially removed or even completely removed to, thereby, eliminate the need to fill it with gas. Front chamber 109 is substantially smaller, such as several times smaller, than the gas firing chamber 124. As above, this avoids use of extra gas for each firing cycle. It is even possible to further reduce the size of completely eliminate front chamber 109 to further reduce the amount of gas behind the paintball 110 before launch down to a minimal or insignificant amount.

The gas release member 114 includes an elongated stem portion 114*a* with a front sealing portion 114*b* with an O-ring 116 positioned therearound. A centering 114*c* pin is also provided on the front most portion 114*b* of the gas release member 114. The gas release member 114 is slidably received in the bolt 112, which has a slot 112*a* therethrough. It should be noted that the bolt 112 is shown with two portions that are threaded together to form the bolt structure. It should be understood that the bolt 112 may be of a unitary construction. The gas release member 114 includes a firing pin 120 that is fixed thereto. As a result, the extent of travel of the gas release member 114 relative to the bolt 112 is defined by the slot 112*a* in the bolt 112, as will be further discussed below. Therefore, the gas release member 114 actuates back and forth within the bolt 112 and is spring-biased, by a spring 122, into a forward position so that the front most portion 114*b* and centering pin 114*c* of the gas release member 114 resides on a seat 112*b* and with the O-ring sealing thereacross. A keyway 112*c* is also preferably provided to receive centering pin 114*c*. Thus, along with numerous other sealing surfaces, the chamber 124 behind the front most portion 114*b* of the gas release member 114 is rendered airtight and is in condition for receipt of gas therein in preparation for paintball launch.

It can also be seen in FIG. 3 that the bolt 112 and gas release member 114, together, actuate back and forth within the sleeve 103 residing in housing 102. Still further, the firing pin 120, affixed to the gas release member 114 also serves to limit the amount of travel of the mated bolt 112 and gas release member 114 because the firing pin also is slidably positioned within a slot 103*a* in the sleeve 103 inserted into housing 102. In FIG. 3, the firing pin 120 is located at the rear of the slot 103*a* in the sleeve, which serves as a stop.

In the paintball loading step seen in FIG. 3, the bolt 112 and the gas release member 114 are both in their rearward most position. A newly loaded paintball 110 is delivered into the breech 106 and is positioned in front of the bolt 112, preferably at a curved leading surface 112*e*, and the system is prepared for launch. The chamber 124 is defined inside the bolt 112 and rearward of the sealing location at the O-ring 116. In this position, the front portion 114*b* of the air release member 114 at the head of the bolt 112 is sealed off so no air is being released yet from the firing chamber 124 within the bolt 112 and surrounding the stem portion 114*a* of the gas release member 114. At this point, the firing chamber 124 of gas is ready for release to push the paintball 110 forward through the barrel 104.

Figure 4:
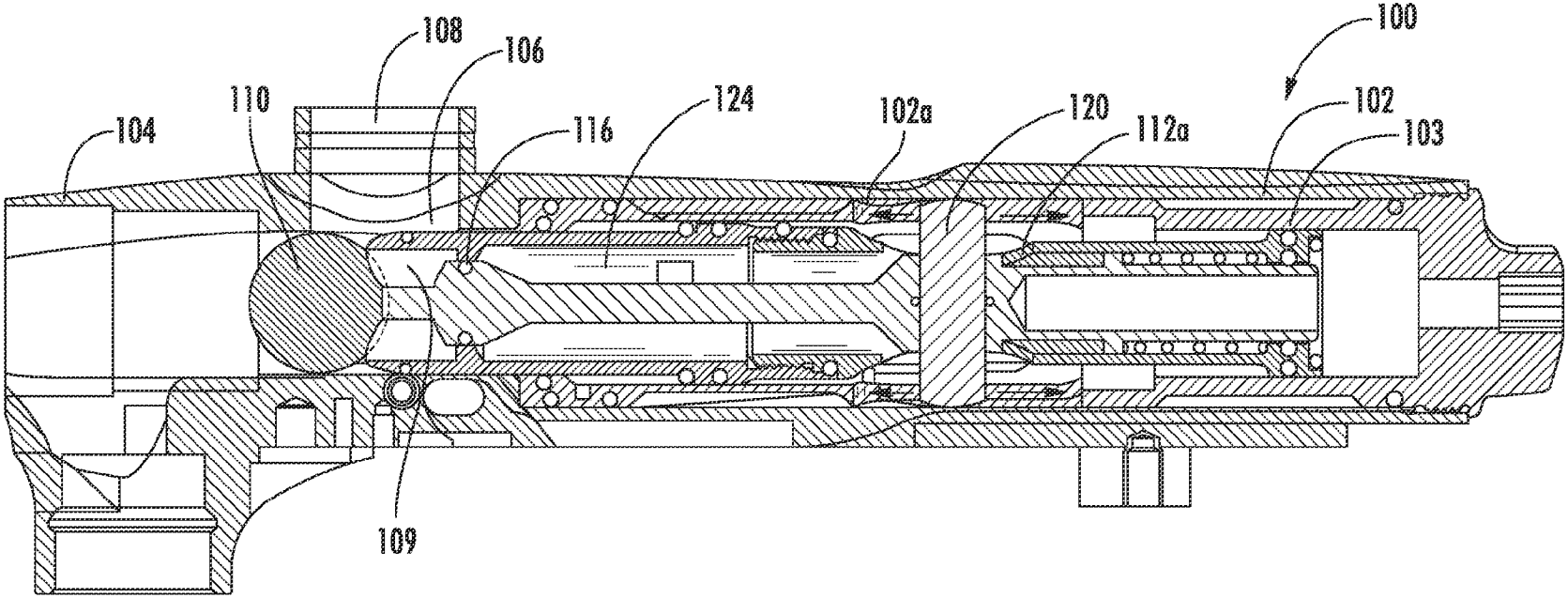
FIG. 4 is a cross-sectional view of the marker of FIG. 3 with the bolt and air release mechanism moving together toward a projectile launching position.

Turning now to FIG. 4, a cross-sectional view of the paintball marker 100 of FIG. 3 is shown during the next step of moving the paintball 110 to a position in the barrel 104 in preparation for launch. The marker 100 has been fired and the launch cycle has been started. The bolt 112 and gas release member 114 are shown moving forward together, with the paintball 110 being pushed ahead of the bolt 112 towards the barrel 104 ready for launching. The firing chamber 124 remains full of gas as the gas release member 114 is still serving to seal off gas flow to behind the paintball 110. Thus, a fully contained firing chamber 124 is travelling forward in a sealed condition along with the bolt 112 and gas release member 114 in unison. Thus, the bolt 112 and gas release member 114, in FIG. 4, travel together as a single unit with the firing pin 120 moving forward within the slot 103*a* in the sleeve residing in the housing 102.

Figure 5:
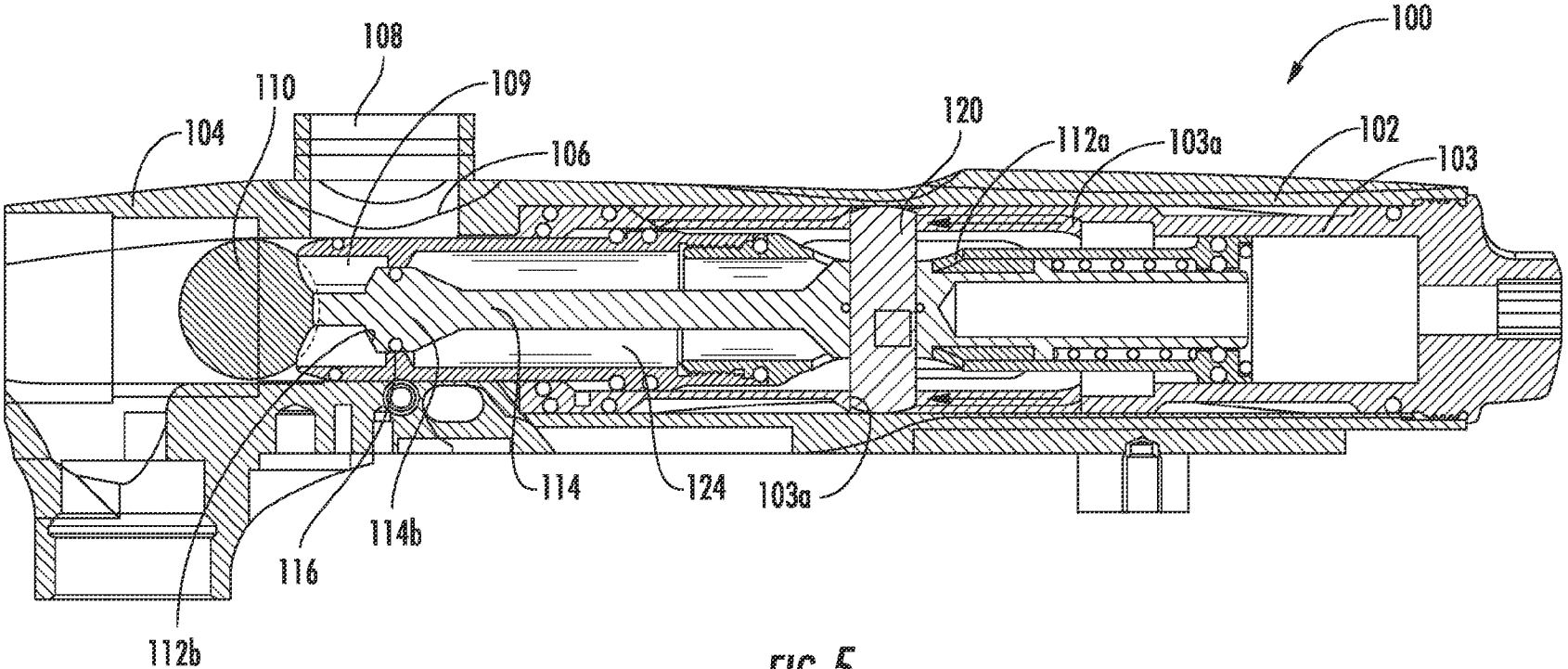
FIG. 5 is a cross-sectional view of the marker of FIG. 3 with the bolt and air release mechanism in a position with the air release at the end of its travel.

Now turning to FIG. 5, the paintball 110 has been moved forward so that it is now loaded in the barrel 104 and the breech 106 is closed off from the feed of additional paintballs (not shown) and the paintball 110 is ready to be actually launched. At this point, the front most portion 114*b* of the gas release member 114 and the O-ring 116 are still in contact with the seat 112*b* of the bolt 112 to maintain the sealed integrity of the gas chamber 124. It can be seen in FIG. 5 that the bolt 112 and the gas release member 114 are still travelling together. However, the firing pin 120, fixed to the gas release member 114, has reached its forward most limit and has contacted the front edge of longitudinal the slot 103*a* in the sleeve 103.

As a result, the air release member 114 cannot travel any further forward. However, due to the further slidable engagement of the firing pin 120 relative the longitudinal slot 112*a* in the bolt 112, further forward travel of the bolt 112 is possible, which will result in the gas release member 114 separating from the bolt 112 thereby opening the seal and allowing the gas from the firing chamber 124 to be released directly behind the paintball 110 for launching.

Figure 6:
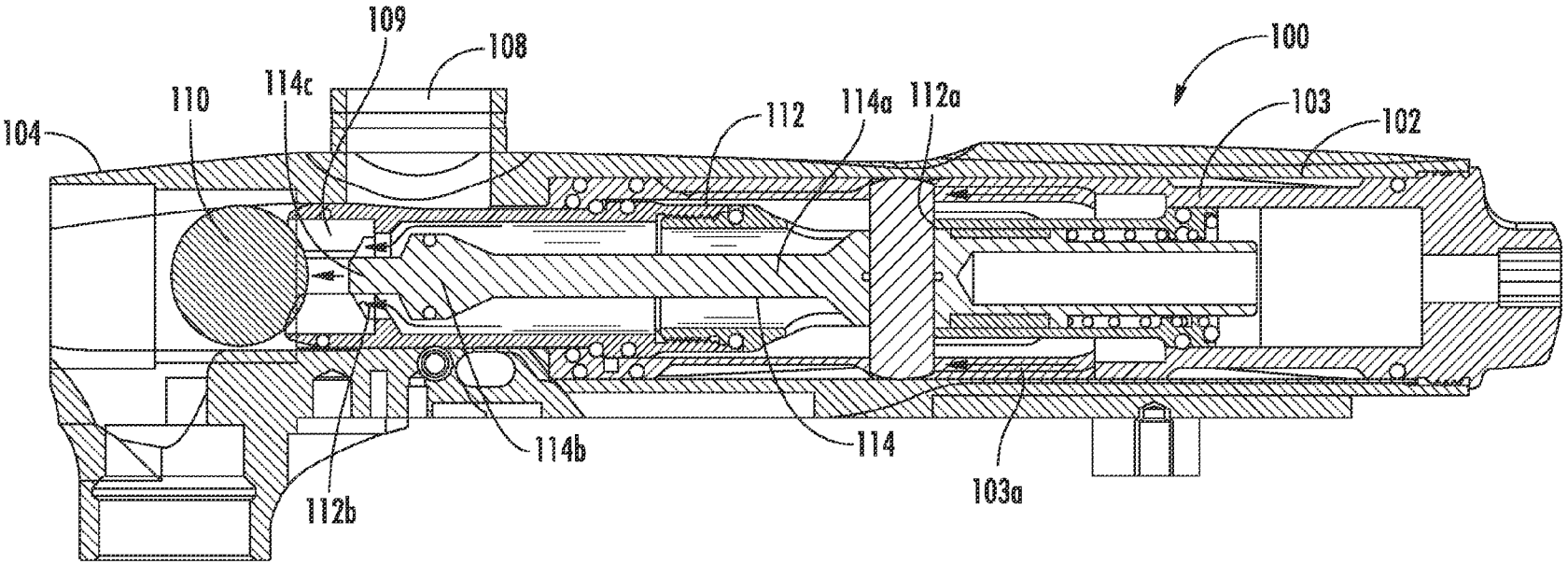
FIG. 6 is a cross-sectional view of the marker of FIG. 3 with the air release at the end of its travel with the bolt moving forward to separate air release therefrom to release air into projectile for launch.

This separation of the bolt 112 and the gas release member 114 is shown in FIG. 6, which illustrates the actual release of gas from chamber 124 and the subsequent launch of the paintball 110. It can be seen that the front edge of the firing pin 120 remains in contact with the front edge of the longitudinal slot 103*a* in the sleeve, serving as a stop, to prevent further forward travel of the gas release member 114 while the rear edge of the firing pin 120 remains in contact with the rear edge of the longitudinal slot 112*a* in the bolt 112. The use of the slots 112*a* and 103*a* and the firing pin 120 connected to the gas release member 114, the actuating travel of the bolt 112 relative to the gas release member 114 and the actuating travel of both the bolt 112 and the gas release member 114 together can be controlled with precision.

Still referring to FIG. 6, the bolt 112 is shown in its forward most position. Because the gas release member 114 cannot move further in the forward direction, the bolt 112 continues on forward on its own to cause the aforementioned release of the seal of the front portion 114*b* of the gas release member 114 with the seat 112*b* at the front of the bolt 112. As can be understood, once this seal is opened, the gas from the chamber 124 is free to exit forward through the front of the bolt 112 to supply gas directly behind the paintball 110 to launch it forward through the barrel 104.

It should be noted that the configuration of the bolt 112 and gas release member 114 are preferred embodiments of the present invention. It is possible to modify the mating configuration, such as the structure of the seat 112*b* and the front portion 114*b* of the gas release member 114 and the location and construction of the firing pin mechanism and still be within the scope of the present invention.

The paintball marker 100 can then be configured to reset in preparation for launch in a number of different ways known in the prior art. For example, springs or pneumatics can be used to move the bolt 112 and gas release member 114 back to the condition see in FIG. 3 in preparation for receipt of a new paintball 110. Movement of such bolts 112 and other components for marker reset are so well known in the art that they need not be discussed herein.

In view of the foregoing, the construction of the present invention can result in a significant increase in marker efficiency due to the fact that there is little or no air lost in filling an empty volume between the back of the paintball 110 and gas release member 114 on every paintball launch. This is made possible by moving the sealing point to a position directly behind the paintball 110.

It would be appreciated by those skilled in the art that various changes and modifications can be made to the illustrated embodiments without departing from the spirit of the present invention. All such modifications and changes are intended to be covered by the appended claims.

What is claimed is:

1. A pneumatic launching assembly, comprising:

a launching body;

a bolt disposed within the launching body and being movable between a loading position, to receive a projectile, and a launching position, that moves a projectile into a launching position; the bolt including an open front end; the front end being in communication with a projectile;

a gas release member disposed through the bolt providing a gas valve behind the projectile with a first gas chamber therebetween; the space between the bolt and the gas release member behind the gas valve defining a second gas chamber; the first gas chamber being substantially smaller than the second gas chamber; the gas release member releasably sealing the open front end of the bolt;

whereby removal of the seal of the gas release member to the bolt releases gas behind the projectile for launching thereof while avoiding wasteful filling of the first gas chamber behind the projectile.

2. The pneumatic launching assembly of claim 1, wherein the gas release member is in direct contact with a projectile to be launched.

3. The pneumatic launching assembly of claim 1, further comprising:

a housing;

a sleeve, having a sleeve longitudinal slot, residing in the housing; the bolt defining a bolt longitudinal slot;

a firing pin connected to the gas release member; the firing pin actuatable in the bolt longitudinal slot and the sleeve longitudinal slot;

the bolt and gas release member movable from a first position with the firing pin at a rear edge of the sleeve longitudinal slot and in a middle portion of the bolt longitudinal slot for paintball loading to a second position with the firing pin at front edge of the sleeve longitudinal slot and at a rear edge of bolt longitudinal slot for paintball launching.

4. The pneumatic launching assembly of claim 1, wherein the bolt includes a seat for receipt of a frontward portion of the gas release member.

5. The pneumatic launching assembly of claim 1, wherein the gas release member further includes a centering pin and the bolt further defines a keyway; the centering pin locatable in the keyway.

6. The pneumatic launching assembly of claim 1, wherein the bolt has a forward most edge that is concave for mating communication with a projectile.

7. The pneumatic launching assembly of claim of claim 1, wherein the gas release member slidably actuates through the bolt.

* * * * *